United States Patent [19]

Satchwell

[11] Patent Number: 4,484,622

[45] Date of Patent: Nov. 27, 1984

[54] INTEGRAL HEADER HEAT EXCHANGER

[75] Inventor: David L. Satchwell, Rolling Hills Estates, Calif.

[73] Assignee: The Garrett Corporation, Los Angeles, Calif.

[21] Appl. No.: 372,136

[22] Filed: Apr. 27, 1982

[51] Int. Cl.[3] ..... F28F 3/06; F28F 9/26

[52] U.S. Cl. ..... 165/153; 165/175

[58] Field of Search ..... 165/129, 153, 178, 175, 165/170

[56] References Cited

U.S. PATENT DOCUMENTS

| | | | |
|---|---|---|---|
| 1,797,636 | 3/1931 | Butler | 165/175 |
| 1,816,111 | 7/1931 | DeFerranti et al. | 165/170 X |
| 2,002,923 | 5/1935 | Palmer | 165/152 |
| 2,298,895 | 10/1942 | McKibben et al. | 29/157.3 B |
| 2,813,701 | 11/1957 | Fenger | 165/152 X |
| 3,017,161 | 1/1962 | Slaasted et al. | 165/166 X |
| 3,207,216 | 9/1965 | Donaldson | 165/175 X |
| 3,451,114 | 6/1969 | Werneke | 228/183 |
| 3,512,238 | 5/1970 | Canon et al. | 29/157.3 B |
| 3,601,878 | 8/1971 | Karmazin | 29/157.3 B |
| 3,734,178 | 5/1973 | Soudron | 165/170 |
| 4,258,785 | 3/1981 | Beldam | 165/153 X |

FOREIGN PATENT DOCUMENTS

| | | | |
|---|---|---|---|
| 849839 | 12/1939 | France | 165/175 |
| 1467127 | 1/1967 | France | 165/175 |
| 535567 | 11/1955 | Italy | 165/129 |
| 1256228 | 12/1971 | United Kingdom | 165/175 |

*Primary Examiner*—Sheldon J. Richter

*Attorney, Agent, or Firm*—Stuart O. Lowry; James W. McFarland; Albert J. Miller

[57] ABSTRACT

A plate-fin heat exchanger is provided with inlet and outlet headers mounted integrally with the heat exchanger core wherein each header includes a fluid fitting adapted for alignment in an individually selected direction.

19 Claims, 3 Drawing Figures

INTEGRAL HEADER HEAT EXCHANGER

BACKGROUND OF THE INVENTION

This invention relates generally to improvements in heat exchangers of the so-called plate-fin type. More specifically, this invention relates to a plate-fin heat exchanger including an improved and simplified header construction.

Plate-fin heat exchangers in general are known in the art for use in transferring heat energy from one working fluid to another. In one common form, such heat exchangers typically comprise a plurality of relatively thin divider plates arranged in an alternating stack with a plurality of extended surface heat transfer elements, such as corrugated fins and the like. The extended surface heat transfer elements, or fins, are commonly turned alternately at right angles with respect to each other to define two closely adjacent fluid flow paths for passage of the two working fluids at right angles to each other. This construction is commonly known as a cross-flow heat exchanger and includes appropriate header bars along side margins of the stack to isolate the two working fluids from one another. When the stack is assembled, the various components thereof are commonly secured together preferably in a single bonding operation, such as by brazing or the like.

Plate-fin heat exchangers further require some type of manifold or header structure for guiding at least one of the working fluids for ingress and egress with respect to its associated flow path through the heat exchanger core in isolation from the other working fluid. For example, when the heat exchanger is used to transfer heat energy between a liquid and a gas, the liquid is normally supplied through an appropriate inlet conduit to an inlet header mechanically connected to the heat exchanger core to guide the liquid for flow into and through one of the flow paths in the core in heat transfer relation with the gas which typically flows freely without headers through the other core flow path. An outlet header mechanically connected to the heat exchanger core collects the liquid discharged from the one flow path for passage away from the heat exchanger through an appropriate outlet conduit.

The inlet and outlet headers have been the subject of significant engineering activity in an effort to simplify heat exchanger design and reduce cost of manufacture while increasing the versatility and operating life of the heat exchanger. In this regard, the inlet and outlet headers conventionally have constituted mechanical structures independent of the heat exchanger core adapted for attachment to the core subsequent to bonding of the various core-forming components. While such separate header structures advantageously permit the headers to include fluid fittings oriented in a selected direction for convenient connection to the associated inlet and outlet fluid conduits, they increase the mechanical complexity of the heat exchanger as well as the cost of manufacture by requiring more than one bonding operation.

Other heat exchanger designs have been proposed which attempt to incorporate inlet and outlet headers directly into the heat exchanger core thereby permitting the core and the headers to be assembled in a single cost-efficient bonding operation. However, these designs have not included inlet and outlet fluid fittings adapted for orientation in any selected direction for connection to the associated inlet and outlet fluid conduits. Instead, such designs have required the subsequent addition of appropriately directed fluid fittings which are attached to the headers by a subsequent bonding operation.

The present invention overcomes the problems and disadvantages of the prior art by providing an improved and simplified heat exchanger construction having inlet and outlet headers incorporated integrally with a heat exchanger core wherein each header includes a fluid fitting adapted for orientation in a selected direction prior to connection of the heat exchanger components in a single bonding operation.

SUMMARY OF THE INVENTION

In accordance with the invention, a plate-fin heat exchanger has a heat exchanger core defining a pair of internal flow paths for passage of a pair of working fluids in heat transfer relation with each other. The heat exchanger core is constructed with integrally mounted inlet and outlet headers for guiding one of the working fluids into and through one of the flow paths in isolation with the other fluid, wherein each of the headers includes a fluid fitting adapted to be oriented in any selected direction for easy connection to a fluid inlet or outlet conduit.

The plate-fin heat exchanger is defined by a plurality of divider plates arranged in an alternating stack with a plurality of first and second extended surface heat transfer elements, or fins. In general, the first heat transfer elements are arranged alternately at right angles to the second heat transfer elements to extend alternately lengthwise and crosswise with respect to the divider plates to define the two flow paths for respective passage of the two working fluids generally at right angles to each other. At least the flow path defined by the first heat transfer elements is closed at its periphery by header bars connected between the associated pairs of divider plates to isolate the flow paths from each other and thereby prevent intermingling of the working fluids during operation.

In a preferred form of the invention, the inlet and outlet headers are incorporated into the heat exchanger core generally at the opposite ends of the flow path bounded by the header bars for guiding one of the working fluids into and through that flow path. Each header comprises a plurality of aligned cylindrical header tubes each connected between an associated pair of the divider plates sandwiching the second heat transfer elements for communication through aligned openings in the divider plates with the flow path defined by the first heat transfer elements. Each header further includes a fluid fitting having a tubular first portion connected between a selected pair of the divider plates sandwiching at least one of the second heat transfer elements and aligned with the header tubes, wherein the tubular first portion is joined to a generally outwardly projecting tubular second portion for connection with an associated inlet or outlet fluid conduit.

The fluid fitting of each header is adapted for orientation of its associated tubular second portion to project outwardly from the heat exchanger core in a selected direction by rotating the tubular first portion of the fluid fitting about its own axis. Moreover, in a preferred embodiment of the invention, each fluid fitting is conveniently positioned between a pair of divider plates sandwiching back-to-back second heat transfer elements such that a significant space is provided into which the fluid fitting is mounted whereby the fluid fitting can be formed to have a relatively large size for relatively high fluid flow therethrough.

After assembly of the heat exchanger components including the divider plates, the first and second heat transfer elements, the header bars, and the header, the various components are conveniently connected together in a single bonding operation, such as by brazing or the like, to form a unitary heat exchanger core construction.

Other features and advantages of the invention described herein will become more apparent from the following detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
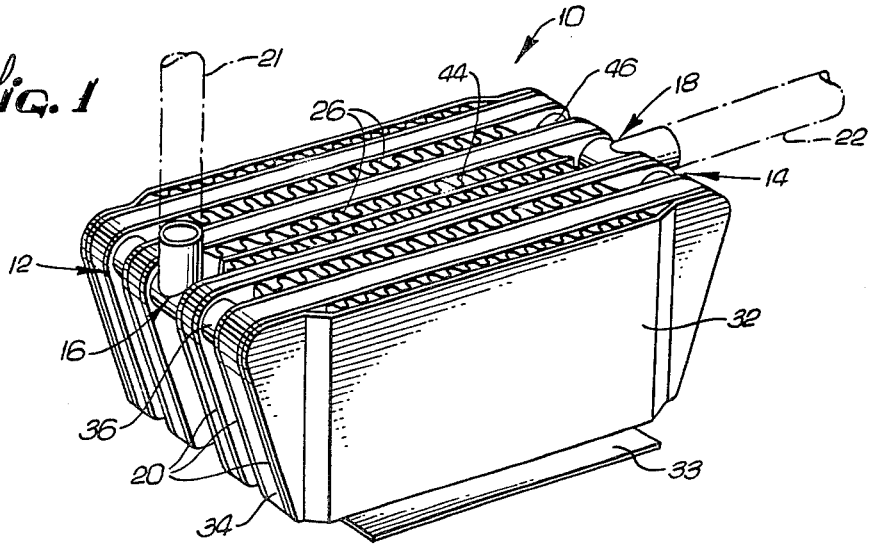
FIG. 1 is a perspective view illustrating a plate-fin heat exchanger embodying the novel features of the invention.

As shown in the exemplary drawings, a heat exchanger embodying the novel features of this invention is referred to generally by the reference numeral 10. This heat exchanger 10 is of the so-called plate-fin type and includes a pair of internal flow paths (not shown in FIG. 1) for passage of two working fluids in heat exchange relation with each other. One of the working fluids is coupled for flow to and from the heat exchanger through an inlet header 12 and an outlet header 14. These headers 12 and 14 are mounted integrally with the heat exchanger core and respectively include fluid fittings 16 and 18 adapted for orientation to project in individually selected directions away from the heat exchanger.

The plate-fin heat exchanger 10 of this invention provides a simplified and economical, yet highly versatile, heat exchanger construction. The heat exchanger advantageously can be assembled from its various components, and then those components can be appropriately connected to each other in a single bonding operation, such as by brazing or the like. The inlet and outlet headers 12 and 14 constitute integral portions of the heat exchanger core and thus are incorporated into the core without requiring subsequent attachment of any header structure. Moreover, the headers 12 and 14 include the fluid fittings 16 and 18 which are adapted to project in individually selected directions for appropriate connection respectively to inlet and outlet fluid conduits 21 and 22 shown in dotted lines in FIG. 1. Accordingly, the heat exchanger 10 can be formed with the fluid fittings 16 and 18 positioned to correspond with a particular working environment for connection to the fluid conduits 20 and 22 simply by orienting the fluid fittings at selected angular directions prior to bonding of the heat exchanger components without any other alteration in the design or construction of the heat exchanger.

Figure 2:
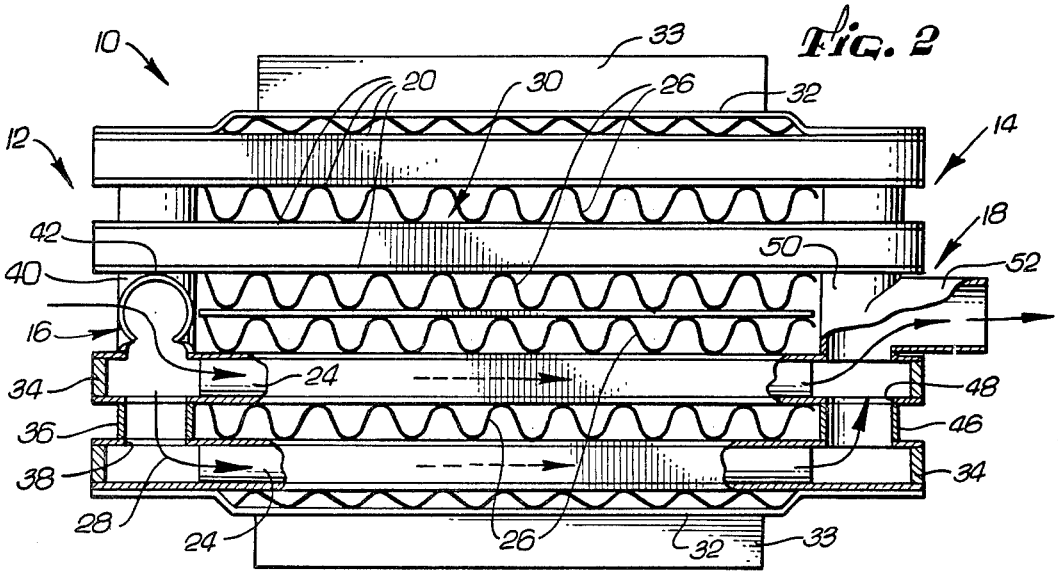
FIG. 2 is an enlarged fragmented top plan view of the heat exchanger, with portions broken away to illustrate construction details thereof.
Figure 3:
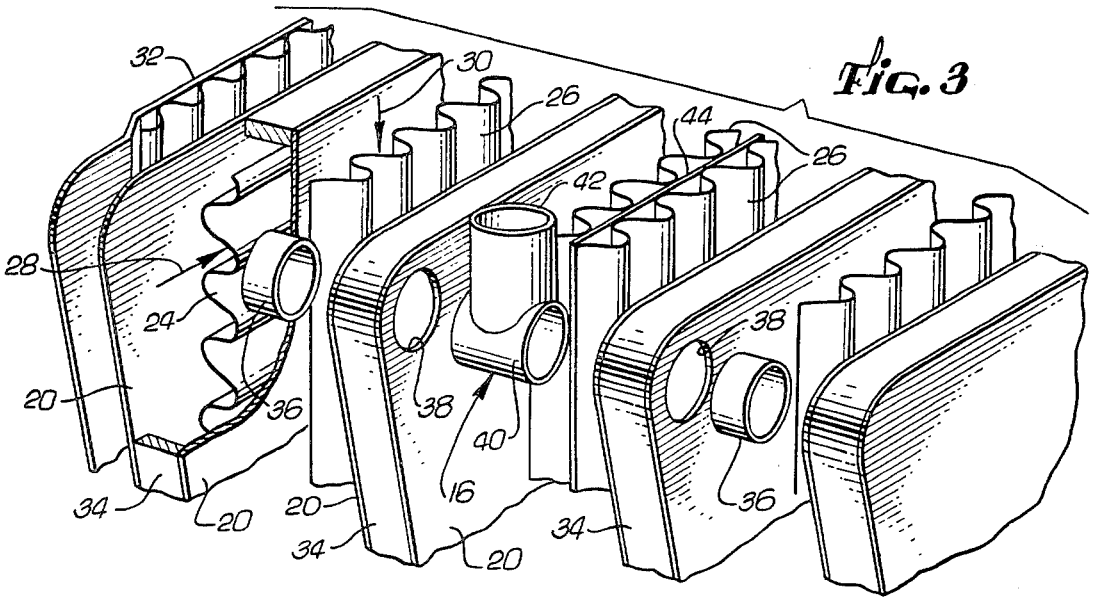
FIG. 3 is an enlarged fragmented exploded perspective view illustrating assembly of the heat exchanger.

The construction and operation of the plate-fin heat exchanger 10 of this invention is illustrated in more detail in FIGS. 2 and 3. As shown, the heat exchanger 10 includes a heat exchanger core defined by a plurality of relatively thin divider plates 20 stacked alternatingly with a plurality of first extended surface heat transfer or fin elements 24 and a plurality of second extended surface heat transfer or fin elements 26.

For the most part, as shown in the illustrative embodiment, these first and second heat transfer elements 24 and 26 are stacked alternately between the divider plates 20 to extend respectively generally in a lengthwise and crosswise direction with respect to the divider plates. More specifically, the first heat transfer elements 24 each have a generally corrugated finlike cross-sectional shape which cooperates with the associated sandwiching pair of divider plates 20 to define a plurality of relatively small fluid flow passages extending in a lengthwise direction with respect to the divider plate 20. These small flow passages are arranged in layers throughout the heat exchanger core and define a first flow path referred to in FIG. 2 by arrows 28 for passage of a first working fluid.

Similarly, the second heat transfer elements 26 also have a generally corrugated finlike construction cooperating with their associated sandwiching pairs of divider plates 20 to define a plurality of relatively small flow passages extending in a crosswise direction with respect to the divider plates 20. These crosswise flow passage define a second fluid flow path referred to in the drawings by arrows 30 for passage of a second working fluid in layers throughout the heat exchanger core. Importantly, the divider plates 20 and the heat transfer elements 24 and 26 are constructed from a suitable material with relatively high thermal conductivity such that the layered passage of the two working fluids brings those fluids into relatively efficient heat transfer association with one another. Conveniently, the entire heat exchanger core is sandwiched between a pair of side plates 32 which can have an increased thickness to protect the heat exchanger 10 from damage and which can further include flanges 33 or other suitable structure to facilitate mounting of the heat exchanger in the desired operation environment.

The plate-fin heat exchanger 10 is adapted for mounting within a flow stream of a gas, such as air, which constitutes the second working fluid. More specifically, the opposite ends of the second heat transfer elements 26 are exposed for open flow of the gas without any manifold or header structure into and through the second flow path 30. This gas thus passes in heat exchange relation with the first working fluid coupled for flow through the first flow path 28.

The first flow path 28 is isolated from the second flow path 30 to prevent physical intermingling of the two working fluids. In this regard, the inlet and outlet headers 12 and 14 are mounted generally at opposite ends of the first flow path 28 for communicating the first working fluid such as a liquid coolant or the like, for flow through the first flow path 28. Importantly, the peripheral boundaries of the divider plates 20 sandwiching the first heat transfer elements 24 are closed by appropriately shaped header bars 34 to isolate the first flow path 28 from the second working fluid.

In accordance with a primary aspect of the invention, the inlet and outlet headers 12 and 14 are incorporated directly into the heat exchanger core between the various pairs of divider plates 20 for guiding flow of the first working fluid into and through the first flow path 28. More specifically, the inlet header 12 comprises a plurality of aligned and generally cylindrical header tubes 36 each interposed between an associated pair of divider plates 20 sandwiching the second heat transfer elements 26. These header tubes 36 guide the first working fluid from the inlet fluid fitting 16 across the end of the heat exchanger through aligned holes 38 in the divider plates for open flow into the first flow path 28, as shown best in FIG. 2. Accordingly, the header tubes 36 effectively isolate the first working fluid from the second flow path 30.

The inlet header 12 further includes the fluid fitting 16 which cooperates with the header tubes 36 to supply the first working fluid from the associated inlet conduit 20 to the first flow path 28. In particular, the fluid fitting 16 comprises a tubular first portion 40 interposed between one selected pair of the divider plates 20 sandwiching at least one of the second heat transfer elements 26 and defining an open flow path for guiding the first working fluid through the aligned holes 38 in the plates and further through the aligned header tubes 36 to the first flow path 28. The tubular first portion 40 is joined to a tubular second portion 42 projecting outwardly therefrom for suitable connection to the inlet conduit 20. Accordingly, the inlet fluid fitting 16 can be oriented with the tubular second portion 42 projecting outwardly in any selected direction by appropriate rotation of the first tubular portion 40 about its own axis. The fluid fitting can thus be oriented as desired to accommodate the position of the inlet conduit 20 without any impact upon flow of the first working fluid through the first flow path 28.

As shown in FIG. 3, the inlet fluid fitting 16 is advantageously positioned between a pair of the divider plates 20 sandwiching more than one of the second heat transfer elements 26 in a double-layer or back-to-back relation. More specifically, as shown, two of the second heat transfer elements 26 are separated from each other by a relatively thin separation plate 44 which has a length slightly shorter than the length of the divider plate 20 to terminate short of the adjacent inlet fitting 16. This separation plate 44 and its sandwiching second heat transfer elements 26 are in turn sandwiched between the adjacent divider plates 20 to provide a mounting location for the inlet fluid fitting 16 of enlarged dimension relative to the spacing between the remaining divider plates 20 of the heat exchanger core. This enlarged dimension permits the inlet fluid fitting 16 to have a relatively large cross-sectional flow area formed through the tubular first and second portions 40 and 42 such that the first working fluid can be supplied to the heat exchanger with a relatively high flow rate. Alternatively stated, the inlet header 12 does not provide any significant restriction to flow of the first working fluid into the first flow path 28.

The first working fluid exits the first flow path 28 and is collected at the opposite end by the outlet header 14 for further flow away from the heat exchanger 10 through the outlet conduit 22. This outlet header 14 is defined by an aligned plurality of generally cylindrical header tubes 46 which are mounted between associated pairs of the divider plates 20 sandwiching the second heat transfer elements 26. These latter header tubes 46, as shown in FIG. 2, isolate the collected fluid from the second flow path 30 and guide the collected fluid through aligned openings 48 in the divider plates 20 to the outlet fluid fitting 18.

The outlet fluid fitting 18 is generally identical with the inlet fluid fitting 16 to include a tubular first portion 50 connected between a selected pair of the divider plates in a position aligned with the header tubes 46. The first working fluid is thus collected into the tubular first portion for flow away from the heat exchanger through an integral tubular second portion 52. Importantly, this tubular second portion 52 is oriented at a selected angle by appropriate rotation of the tubular first portion 50 about its own axis for aligned connection with the outlet conduit 22.

The particular pair of divider plates 20 between which the outlet fitting 18 is mounted conveniently comprises the same divider plates 20 between which the inlet fluid fitting 16 is mounted. With this construction, the outlet fluid fitting 18 is positioned adjacent the double-layer stack of the second heat transfer elements 26 with the separation plate 44 terminating short of the outlet fitting. The outlet fluid fitting is thus located in an enlarged space relative to the spacing between the remaining pairs of divider plates such that the outlet fitting can be formed with an enlarged flow area through its first and second tubular portions 50 and 52 to avoid restriction of fluid flow therethrough. Alternatively, if desired, the heat exchanger can be provided with an additional double-layer stack of second heat transfer elements 26 at a different location within the core and the outlet fluid fitting 18 can be mounted between the particular divider plates associated with the additional double-layer stack.

After the heat exchanger components are arranged in the desired stack, including appropriate orientation of the inlet and outlet fluid fittings 16 and 18, the entire assembly can undergo a single bonding operation, such as brazing or the like, to result in a rigid unitary heat exchanger construction. The inlet and outlet fluid fittings 16 and 18 can thus be oriented as required by the particular working environment during the single bonding operation and without impacting the remaining construction and operation of the heat exchanger.

A variety of modifications and improvements to the heat exchanger described herein are believed to be apparent to one skilled in the art. Accordingly, no limitation of the invention is intended, except as set forth in the appended claims.

What is claimed is:

1. A heat exchanger, comprising:

a core formed by a plurality of divider plates arranged in an alternating stack with a plurality of extended surface heat transfer elements to define first and second flow paths for respective passage of first and second working fluids in heat exchange relation with each other, said heat transfer elements being sandwiched between predetermined pairs of said divider plates and cooperating therewith to define said second flow path; and header means for communicating with the first flow path, said header means being mounted between adjacent pairs of said divider plates in the stack and including a fluid fitting mounted between one of said predetermined pairs of said divider plates and projecting in a selected direction generally away from said divider plates, said one of said predetermined pairs of divider plates sandwiching at least two of said elements in a multiple layer relation.

2. A heat exchanger as set forth in claim 1 wherein said header means comprises an inlet header for communicating the first working fluid for flow into the first flow path.

3. A heat exchanger as set forth in claim 1 wherein said header means comprises an outlet header for communicating with the first flow path for flow of the first fluid therefrom.

4. A heat exchanger as set forth in claim 1 wherein said header means comprises an inlet header generally at one end of said core for communicating the first working fluid for flow into the first flow path and an outlet header generally at an opposite end of said core for collecting the first fluid flowing from the first flow path, said inlet and outlet headers respectively including an inlet fluid fitting and an outlet fluid fitting each projecting in an individually selected direction generally away from said divider plates.

5. A heat exchanger as set forth in claim 1 wherein said core further includes means for isolating the first flow path from the second path.

6. A heat exchanger as set forth in claim 1 wherein said heat transfer elements comprise a plurality of first elements sandwiched between selected pairs of said divider plates and cooperating therewith to define the first flow path, and a plurality of second elements sandwiched between other pairs of said divider plates and cooperating therewith to define the second flow path, and wherein said header means comprises said fluid fitting mounted between one of the pairs of divider plates sandwiching at least two of said second elements in a multiple layer relation and a plurality of header tubes mounted generally in alignment therewith between the remaining pairs of divider plates sandwiching said second elements, said divider plates having openings formed therein in alignment with said fluid fitting and said header tubes for flow communication between said header means and the first flow path.

7. A heat exchanger as set forth in claim 6 wherein said fluid fitting has a first tubular portion mounted between said one of the pairs of said divider plates generally in alignment with said header tubes, and a second tubular portion projecting in a selected direction generally away from said first tubular portion and said divider plates in accordance with the rotational position of said first tubular portion about its own axis.

8. A heat exchanger as set forth in claim 6 wherein said header means comprises an inlet header and an outlet header generally at opposite ends of the first flow path and each including one of said fluid fittings and a plurality of header tubes, said fluid fittings of said inlet and outlet headers being mounted between a pair of said divider plates sandwiching at least two of said second elements in a multiple layer relation.

9. A heat exchanger, comprising:

a core formed by a plurality of divider plates arranged in an alternating stack with a plurality of extended surface heat transfer elements to define first and second flow paths for respective passage of first and second working fluids in heat exchanger relation with each other, said heat transfer elements being sandwiched between predetermined pairs of said divider plates and cooperating therewith to define said second flow path;

an inlet header for communicating the first working fluid to the first flow path, said inlet header being mounted between adjacent pairs of said divider plates in the stack and including an inlet fluid fitting mounted between one of said predetermined pairs of said divider plates and projecting in a selected direction generally away from said divider plates; and an outlet header for collecting the first fluid flowing from the first flow path, said outlet header being mounted between adjacent pairs of said divider plates in the stack and including an outlet fluid fitting mounted between one of said predetermined pairs of said divider plates and projecting in a selected direction generally away from said divider plates, said one of said predetermined pairs of said divider plates associated with said outlet fluid fitting sandwiching at least two of said second elements in a multiple layer relation.

10. A heat exchanger, comprising:

a core formed by a plurality of divider plates arranged in an alternating stack with a plurality of extended surface heat transfer elements to define first and second flow paths for respective passage of first and second working fluids in heat exchanger relation with each other, said heat transfer elements being sandwiched between predetermined pairs of said divider plates and cooperating therewith to define said second flow path;

an inlet header for communicating the first working fluid to the first flow path, said inlet header being mounted between adjacent pairs of said divider plates in the stack and including an inlet fluid fitting mounted between one of said predetermined pairs of said divider plates and projecting in a selected direction generally away from said divider plates, said one of said predetermined pairs of said divider plates associated with said inlet fluid fitting sandwiching at least two of said second elements in a multiple layer relation; and an outlet header for collecting the first fluid flowing from the first flow path, said outlet header being mounted between adjacent pairs of said divider plates in the stack and including an outlet fluid fitting mounted between one of said predetermined pairs of said divider plates and projecting in a selected direction generally away from said divider plates.

11. A heat exchanger as set forth in claim 10 wherein said inlet and outlet headers are mounted generally at opposite ends of said core and generally at opposite ends of the first flow path.

12. A heat exchanger as set forth in claim 11 wherein said heat transfer elements comprise a plurality of first elements sandwiched between selected pairs of said divider plates and cooperating therewith to define the first flow path, and a plurality of second elements sandwiched between other pairs of said divider plates and cooperating therewith to define the second flow path, said inlet fluid fitting being mounted between one of the pairs of divider plates sandwiching at least two of said second elements in a multiple layer relation and said inlet header further including a plurality of inlet header tubes mounted generally in alignment with said inlet fluid fitting and mounted between the remaining pairs of divider plates sandwiching said second elements, said outlet fluid fitting being mounted between one of the pairs of divider plates sandwiching said second elements and said outlet header further including a plurality of outlet header tubes mounted generally in alignment with said outlet fluid fitting and mounted between the remaining pairs of divider plates sandwiching said second element.

13. A heat exchanger as set forth in claim 12 wherein said outlet fluid fitting is mounted between a pair of said divider plates sandwiching at least two of said second elements in a multiple layer relation.

14. A heat exchanger as set forth in claim 10 wherein said inlet and outlet fluid fittings each include a first tubular portion mounted between said one of the pairs of said divider plates generally in alignment with said associated header tubes, and a second tubular portion projecting in a selected direction generally away from said first tubular portion and said divider plates in accordance with the rotational position of said first tubular portion about its own axis.

15. A heat exchanger, comprising:

a heat exchanger core formed by a plurality of first and second extended surface heat transfer elements arranged generally in an alternating stack with a plurality of divider plates, said first elements cooperating with the associated sandwiching pairs of said divider plates to define a first flow path for passage of a first working fluid and said second elements cooperating with the associated sandwiching pairs of said divider plates to define a second flow path for passage of a second working fluid in heat transfer relation with said first working fluid;

an inlet header for communicating the first working fluid to said first flow path, said inlet header including an inlet fluid fitting having a first portion mounted between a selected associated pair of said divider plates sandwiching at least two of said second elements and a second portion projecting therefrom in a selected direction generally away from said core, said inlet header further including a plurality of inlet header tubes mounted generally in alignment with the reamining pairs of said divider plates sandwiching at least one of said second elements, said divider plates having aligned inlet openings formed therein for passage of the first working fluid through said inlet fluid fitting and said inlet header tubes to said first flow path; and an outlet header for collecting the first working fluid flowing from said first flow path, said outlet header including an outlet fluid fitting having a first portion mounted between a selected associated pair of said divider plates sandwiching at least two of said second elements and a second portion projecting therefrom in a selected direction generally away from said core, said outlet header further including a plurality of outlet header tubes mounted generally in alignment with the remaining pairs of said divider plates sandwiching at least one of said second elements, said divider plates having aligned outlet openings formed therein for passage of the first working fluid from said first flow path through said outlet header tubes and said outlet fluid fitting.

16. A heat exchanger as set forth in claim 15 wherein said core further includes means for isolating the first flow path from the second path.

17. A heat exchanger as set forth in claim 15 wherein said inlet and outlet headers are mounted generally at opposite ends of said core and generally at opposite ends of the first flow path.

18. A heat exchanger as set forth in claim 15 wherein said inlet and outlet fluid fittings are mounted between the same selected pair of said divider plates.

19. A heat exchanger, comprising:

a heat exchanger core formed by a plurality of first and second extended surface heat transfer elements arranged generally in an alternating stack with a plurality of divider plates, said first elements cooperating with the associated sandwiching pairs of said divider plates to define a first flow path for passage of a first working fluid and said second elements cooperating with the associated sandwiching pairs of said divider plates to define a second flow path for passage of a second working fluid in heat transfer relation with said first working fluid; and header means for communicating with the first flow path, said header means including a fluid fitting having a first portion mounted between a selected pair of said divider plates sandwiching at least two of said second elements and a second portion projecting therefrom in a selected direction generally away from said core, said header means further including a plurality of header tubes mounted generally in alignment with said fluid fitting and between the remaining pairs of said divider plates sandwiching at least one of said second elements, said divider plates having aligned openings therein for passage of the first working fluid through said fluid fitting and said header tubes in communicating with said first flow path.

* * * * *